US007031632B2

(12) United States Patent
Deguchi et al.

(10) Patent No.: US 7,031,632 B2
(45) Date of Patent: Apr. 18, 2006

(54) IMAGE FORMING APPARATUS INCLUDING AIR-FLOW DIRECTION CHANGING AROUND TRANSFERRING DEVICE

(75) Inventors: Hideaki Deguchi, Nagoya (JP); Satoru Ishikawa, Shikatsu-cho (JP); Hidenori Hisada, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/957,640

(22) Filed: Oct. 5, 2004

(65) Prior Publication Data

US 2005/0078976 A1 Apr. 14, 2005

(30) Foreign Application Priority Data

Oct. 10, 2003 (JP) ..... 2003-352101

(51) Int. Cl.
*G03G 21/00* (2006.01)

(52) U.S. Cl. ..... 399/92

(58) Field of Classification Search ..... 399/92, 399/111

See application file for complete search history.

(56) References Cited

U.S. PATENT DOCUMENTS 5,418,604 A * 5/1995 Nagakura et al. ..... 399/16
6,021,290 A * 2/2000 Hamada et al. ..... 399/92
6,141,512 A * 10/2000 Nagano et al. ..... 399/92

FOREIGN PATENT DOCUMENTS

JP 11052818 A * 2/1999
JP 2003330350 A * 11/2003

* cited by examiner

*Primary Examiner*—Quana M. Grainger
(74) *Attorney, Agent, or Firm*—Oliff & Berridge, PLC

(57) ABSTRACT

A processing apparatus, including an image carrier which carries a developing-material image formed by developing an electrostatic latent image with a developing material, a transferring device which transfers the developing-material image from the image carrier to a transfer object, and a cover member which at least partly covers the transferring device. The cover member has one or more air-flow holes which allow an air to flow therethrough between an inner side thereof opposed to the transferring device and an outer side thereof opposite to the inner side.

21 Claims, 7 Drawing Sheets

IMAGE FORMING APPARATUS INCLUDING AIR-FLOW DIRECTION CHANGING AROUND TRANSFERRING DEVICE

The present application is based on Japanese Patent Application P2003-352101, filed on Oct. 10, 2003, the contents of which are incorporated herein by reference.

BACKGROUND OF THE INVENTION

1. Field of the Invention

The present invention relates to an image forming apparatus such as a laser printer, and a processing apparatus which is employed by, e.g., an image forming apparatus.

2. Discussion of Related Art

There has been known an image forming apparatus, such as a laser printer, that includes a photosensitive drum, and an electrifier, a scanner, a developing roller, and a transferring roller all of which are provided in the order of description around the photosensitive drum in the direction of rotation of the drum. As the photosensitive drum is rotated, first, an outer circumferential surface of the drum is uniformly electrified, i.e., electrically charged by the electrifier, and subsequently the outer surface is exposed to a high-speed scanning of a laser beam emitted by the scanner. Thus, electrostatic latent images corresponding to image data are formed in the outer surface of the photosensitive drum. Then, as the developing roller is rotated while being engaged with the photosensitive drum, toner carried on an entire outer surface of the developing roller is selectively attracted by only the electrostatic latent images formed in the outer surface of the drum, and thus carried on the outer surface of the same. Thus, toner images are formed on the photosensitive drum. Subsequently, as the photosensitive drum is rotated while being engaged with the transferring roller via a recording sheet, the toner images carried on the outer surface of the drum are transferred to the recording sheet being fed forward by the cooperation of the drum and the roller.

There haven been known two types of transferring rollers each of which can be employed by the above-described image forming apparatus, i.e., an electron-conductive-type roller and an ion-conductive-type roller.

The electron-conductive transferring roller includes a roller portion formed of an elastic material in which electrically conductive particles or fillers are dispersed, and is characterized in that a resistance value of this transferring roller is less changed by the environment, but variations among individual rollers and variations among respective axial portions of each roller are greater and accordingly this roller suffers from a disadvantage that the image transferring operation of the roller cannot be controlled with high stability.

On the other hand, the ion-conductive-type transferring roller includes a roller portion formed of an elastic material to which an ionic substance is added, and is characterized in that a resistance value of this transferring roller is more changed by the environment, but variations among individual rollers and variations among respective axial portions of each roller are smaller and accordingly this roller enjoys an advantage that the image transferring operation of the roller can be controlled with high stability. Thus, the ion-conductive transferring roller is widely used.

However, the ion-conductive transferring roller has the above-described disadvantage that the electric resistance of the roller is greatly changed by the environment. Hence, Japanese Patent Application Publication No. P2003-5614A discloses an image forming apparatus in which a bias is applied to an ion-conductive transferring roller so as to measure a resistance value of the roller, a temperature of the roller is calculated based on the measured resistance value, and a rotation number and a rotation time of a cooling fan are controlled based on the calculated temperature of the roller, i.e., a temperature of the air around the roller.

Thus, in the image forming apparatus disclosed by the above-indicated document, the rotation number and time of the cooling fan are controlled to adjust the temperature of the air around the ion-conductive transferring roller. However, the temperature of the air around the roller cannot be satisfactorily controlled by just controlling the rotation number and/or time of the fan.

Described in more detail a degree of cooling of the transferring roller can be changed by increasing or decreasing the rotation number and/or time of the cooling fan. However, for example, when the image forming apparatus is turned on in a low-temperature environment, the transferring roller cannot be positively heated and accordingly it is difficult to increase quickly and accurately the temperature of the roller up to a required level.

In addition, in the image forming apparatus disclosed by the above-indicated document, the rotation number and time of the cooling fan are finely controlled based on the measured resistance of the transferring roller. Therefore, a complicated control method is needed.

SUMMARY OF THE INVENTION

It is therefore an object of the present invention to provide a processing apparatus and an image forming apparatus each of which is free of at least one of the above-identified problems. It is another object of the present invention to provide a processing apparatus and an image forming apparatus each of which can be easily controlled to quickly increase and/or decrease a temperature of air around a transferring device, based on a resistance value of the transferring device, and thereby stably perform a transferring operation.

The above objects may be achieved according to the present invention. According to a first aspect of the present invention, there is provided a processing apparatus, comprising an image carrier which carries a developing-material image formed by developing an electrostatic latent image with a developing material; a transferring device which transfers the developing-material image from the image carrier to a transfer object; and a cover member which at least partly covers the transferring device. The cover member has at least one air-flow hole which allows an air to flow therethrough between (a) an inner side thereof opposed to the transferring device and (b) an outer side thereof opposite to the inner side. The developing material is, e.g., toner. The transfer object (or target) is, e.g., a recording medium such as a recording sheet. However, the transfer object may be a conveyor belt that is moved from the transferring device to, e.g., a fixing device where the developing-material image is transferred from the conveyor belt to a recording medium.

In the processing apparatus according to the first aspect of the present invention, air outside the cover member and air inside the cover member can be exchanged with each other through the air-flow hole. Therefore, the temperature of the air around the transferring device can be easily adjusted and accordingly the temperature of the transferring device can be quickly and reliably adjusted.

According to a second aspect of the present invention, there is provided an image forming apparatus, comprising a housing; a processing apparatus according to the first aspect of the present invention; and a fixing device which fixes the developing-material image to the recording medium. The processing apparatus is detachably attached to the housing, such that the fixing device is located on a downstream side of the transferring device in a direction of feeding of the transfer object.

In the image forming apparatus according to the second aspect of the present invention, the processing apparatus is detachably attached to the housing, such that the fixing device is located on a downstream side of the transferring device in a direction of feeding of the transfer object. Therefore, the cover member can prevent the transferring device from directly receiving the heat radiated from the fixing device.

According to a third aspect of the present invention, there is provided an image forming apparatus, comprising a processing apparatus including according to the first aspect of the present invention; a resistance-related-value measuring device which measures a resistance-related value of the transferring device; an air-flow-direction changing device which changes a direction of flow of an air around the transferring device; and a control device which controls the air-flow-direction changing device, based on the resistance-related value measured by the resistance-related-value measuring device. The resistance-related value of the transferring device is, e.g., a resistance value itself of the transferring device. However, the resistance-related value may be a voltage of the transferring device when a measurement current is applied thereto, because the voltage is proportional to the resistance.

In the image forming apparatus according to the third aspect of the present invention, the control device that controls the air-flow-direction changing device, based on the resistance-related value measured by the resistance-related-value measuring device, and thereby changes the direction of flow of the air around the transferring device. Thus, the present image forming apparatus can be easily controlled to quickly increase or decrease the temperature of the air around the transferring device, by changing the direction of flow of the air based on the resistance-related value of the transferring device, and thereby stably carry out image transferring operations.

According to a fourth aspect of the present invention, there is provided an image forming apparatus, comprising an image carrier which carries a developing-material image formed by developing an electrostatic latent image with a developing material; a transferring device which transfers the developing-material image from the image carrier to a transfer object; a resistance-related-value measuring device which measures a resistance-related value of the transferring device; an airflow-direction changing device which changes a direction of flow of an air around the transferring device; and a control device which controls the air-flow-direction changing device, based on the resistance-related value measured by the resistance-related-value measuring device.

In the image forming apparatus according to the fourth aspect of the present invention, the control device that controls the air-flow-direction changing device, based on the resistance-related value measured by the resistance-related-value measuring device, and thereby changes the direction of flow of the air around the transferring device. Thus, the present image forming apparatus can be easily controlled to quickly increase or decrease the temperature of the air around the transferring device, by changing the direction of flow of the air based on the resistance value of the transferring device, and thereby stably carry out image transferring operations.

According to a fifth aspect of the present invention, there is provided an image forming apparatus, comprising an image carrier which carries a developing-material image formed by developing an electrostatic latent image with a developing material; a transferring device which transfers the developing-material image from the image carrier to a transfer object; and a cover member which at least partly covers the transferring device. The cover member has at least one air-flow hole which allows an air to flow therethrough between (a) an inner side thereof opposed to the transferring device and (b) an outer side thereof opposite to the inner side.

In the image forming apparatus according to the fifth aspect of the present invention, air outside the cover member and air inside the cover member can be exchanged with each other through the airflow hole. Therefore, the temperature of the air around the transferring device can be easily adjusted and accordingly the temperature of the transferring device can be quickly and reliably adjusted.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DESCRIPTION OF THE PREFERRED EMBODIMENTS

Figure 1:
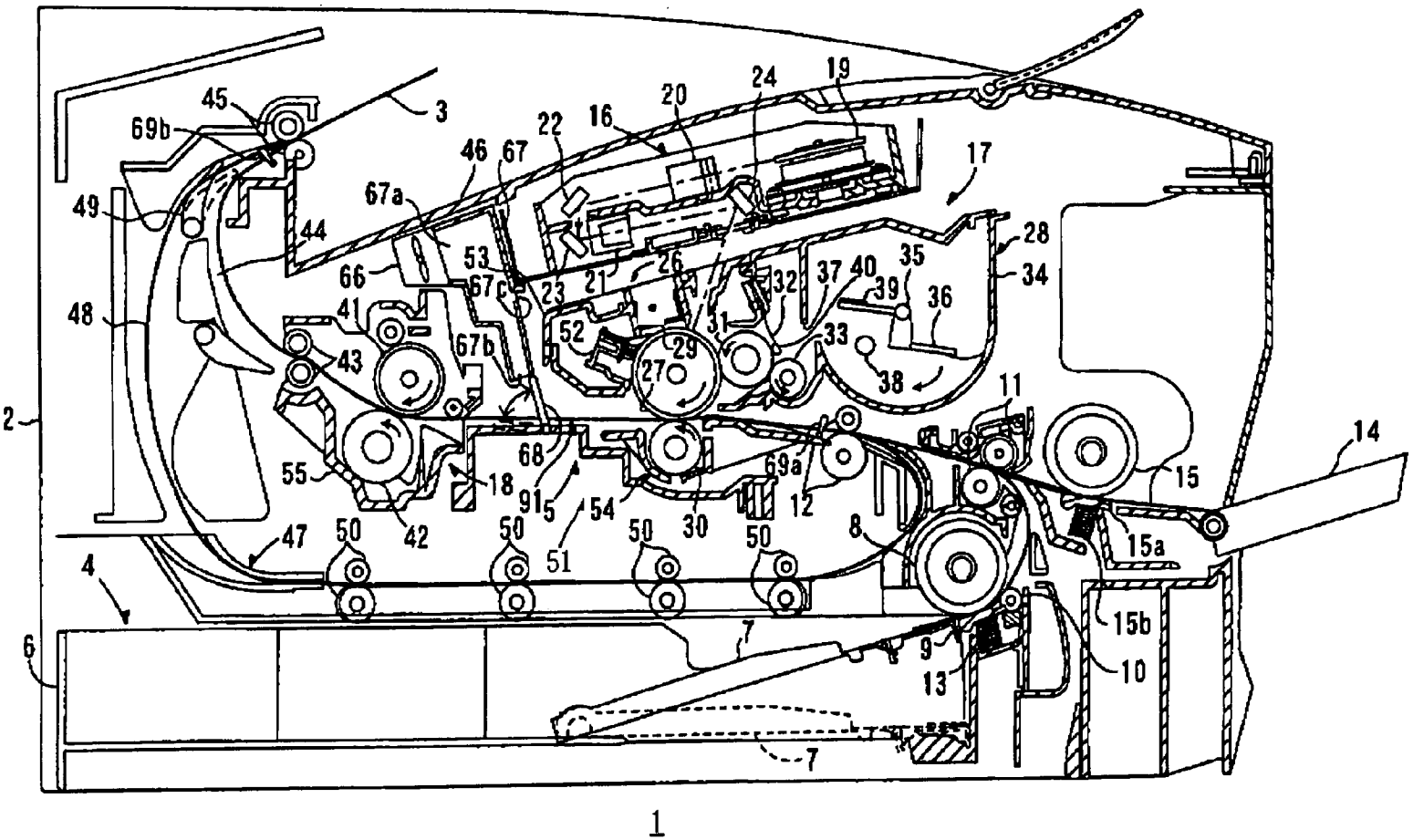
FIG. 1 is a cross-section view of a laser printer as an embodiment of an image forming apparatus in accordance with the present invention.

Hereinafter, there will be described a preferred embodiment of the present invention by reference to the drawings. FIG. 1 shows a laser printer 1 as an embodiment of an image forming apparatus in accordance with the present invention.

In FIG. 1, the laser printer 1 includes a housing 2; a sheet feeding portion 4 that feeds recording sheets 3 each as a sort of recording medium that is a sort of transfer target or object; and an image forming portion 5 that forms an image on each recording sheet 3 fed from the sheet feeding portion 4. The sheet feeding portion 4 and the image forming portion 5 are provided in the housing 2.

The sheet feeding portion 4 includes a sheet feed tray 6; a sheet push plate 7; a sheet feed roller 8 and a sheet feed pad 9; sheet-dust removing rollers 10, 11; and register rollers 12. The sheet feed tray 6 is detachably attached to a bottom portion of the housing 2. The sheet push plate 7 is provided in the sheet feed tray 6. The feed roller and pad 8, 9 are provided above a front end of the sheet feed tray 6. The sheet-dust removing rollers 10, 11 are provided on a downstream side of the sheet feed roller 8 in a sheet feeding direction in which each recording sheet 3 is fed. The register rollers 12 are provided on a downstream side of the sheet-dust removing rollers 10, 11 in the sheet feeding direction.

The sheet push plate 7 pushes upward the recording sheets 3 stacked in the sheet feed tray 6. More specifically described, the sheet push plate 7 is pivotable about one of opposite ends thereof that is remote from the sheet feed roller 8, so that the other end of the push plate 7 is movable upward and downward. A biasing spring, not shown, biases upward a lower surface of the sheet push plate 7. As the number of the recording sheets 3 stacked in the feed tray 6 increases, the push plate 7 is pivoted downward about the end thereof remote from the feed roller 8, against the biasing force of the biasing spring. The sheet feed roller 8 and pad 9 are opposed to each other, and a biasing spring 13 provided under the feed pad 9 biases the pad 9 toward the feed roller 8.

The recording sheet 3 at the top of the stacked recording sheets 3 is pressed against the sheet feed roller 8, by the biasing spring (not shown) provided under the sheet push plate 7. As the feed roller 8 is rotated, the top recording sheet 3 is pinched by the feed roller and pad 8, 9, and is fed forward. Thus, the recording sheets 3 are fed one by one from the sheet feed tray 6.

The sheet-dust removing rollers 10, 11 remove sheet dust from the recording sheet 8 fed from the sheet feed tray 6. Subsequently, the recording sheet 3 is fed to the register rollers 12 consisting of a pair of rollers. After the register rollers 12 register the recording sheet 3, the register rollers 12 feed the recording sheet 3 to an image forming position. The image forming position is an image transferring position where a toner image formed on a photosensitive drum 27 as an image carrier is transferred to the recording sheet 3. In the present embodiment, the image forming position is a position where the photosensitive drum 27 and a transfer roller 30 as an image transferring device engage each other.

The sheet feeding portion 4 additionally includes a multi-purpose tray 14, and a sheet feed roller 15 and a sheet feed pad 15*a* that cooperate with each other to feed each of the recording sheets 3 stacked on the multi-purpose tray 14. The sheet feed roller 16 and pad 15*a* are opposed to each other, and a biasing spring 15*b* provided under the feed pad 15*a* biases the feed pad 15*a* toward the feed roller 15.

As the sheet feed roller 15 is rotated, each of the recording sheets 3 stacked on the multi-purpose tray 14 is pinched by the feed roller and pad 16, 16*a*, and is fed forward.

The image forming portion 6 includes a scanning unit 16, a processing unit 17 as a processing apparatus, and an image fixing portion 18 as an image fixing device.

The scanning unit 16 is provided in an upper portion of the housing 2, and includes a laser-beam emitting portion, not shown, a polygon mirror 19 that is driven or rotated, lenses 20, 21, and reflect mirrors 22, 23, 24. A laser beam that is emitted by the laser-beam emitting portion based on image data is reflected by, or transmitted through, the polygon mirror 19, the lens 20, the reflect mirrors 22, 23, the lens 21, and the reflect mirror 24 in the order of description, as indicated by one-dot chain line, and is incident, at a high scanning speed, to an outer circumferential surface of the photosensitive drum 27.

The processing unit 17 is provided below the scanning unit 16, and includes a drum cartridge 26 that is detachably attached to the housing 2, and a develop cartridge 28 that is detachably attached to the drum cartridge 26.

The develop cartridge 28 includes a develop roller 31, a layer-thickness limiting blade 32, a supply roller 33, and a toner hopper 34.

A rotary agitator 36 is provided in the toner hopper 34, and the hopper 34 is filled with a toner as a sort of developing material. This toner consists' of a single component that is chargeable to be electrically positive, and is a non-magnetic material. For example, the toner is a polymer toner that is obtained by copolymerizing, in a known polymerizing method such as suspension polymerization, polymerizable monomers such as styrene monomers (e.g., styrene or its derivatives), or acrylic monomers (e.g., acrylic acid, alkyl (C1 to C4) acrylate, or alkyl (C1 to C4) methacrylate). The toner is given in the form of generally spherical particles, and has a high fluidity. Thus, the toner can form an image with a high quality.

The toner is mixed with a coloring agent (e.g., carbon black) and/or wax. In addition, an additive agent (e.g., silica) is added to increase the fluidity of the toner. The additive agent is given in the form of particles whose diameter ranges from about 6 μm to about 10 μm.

The toner accommodated in the toner hopper 34 is agitated by the agitator 36 supported by a rotary axis member 35 provided in the center of the hopper 34, while the toner is discharged, little by little, through a toner outlet 37 opening in one side wall of the hopper 34. This agitator 36 is driven or rotated in a direction indicated by an arrow i.e., a clockwise direction), by an electric motor, not shown. The toner hopper 34 has, in each of two opposite side walls thereof, a window 38 that is used to detect a remaining amount of the toner in the hopper 34. Each of the two windows 38 is cleaned by a cleaner supported by the axis member 35.

On one side of the toner outlet 37, there is provided the supply roller 33 that is rotatable. The develop roller 31 that is also rotatable is held in pressed contact with the supply roller 33.

The supply roller 33 includes a metallic axis portion and a roller portion formed of an electrically conductive foam material and covering the axis portion. The supply roller 33 is driven or rotated in a direction indicated by an arrow (i.e., a counterclockwise direction), by an electric motor, not shown.

The develop roller 31 includes a metallic axis portion, and a roller portion formed of an electrically conductive rubber material and covering the axis portion. More specifically described, the roller portion of the develop roller 31 includes a roller body formed of urethane rubber or silicone rubber that is electrically conductive because of containing carbon particles; and a coating layer formed of urethane rubber or silicone rubber that contains fluorine and covering the roller body. When an image developing operation is carried out, a developing bias (voltage) is applied to the develop roller 31.

The develop roller 31 is driven or rotated in a direction indicated by an arrow (i.e., a counterclockwise direction), by an electric motor, not shown.

The layer-thickness limiting blade 32 is provided in the vicinity of the develop roller 31. The limiting blade 32 includes a base portion formed of a metallic leaf spring, and a press portion 40 provided at an end of the base portion and formed of an electrically insulating silicone rubber so as to have a semi-circular cross section. The limiting blade 32 is supported by the develop cartridge 28, in the vicinity of the develop roller 31, such that the press portion 40 of the blade 32 is held in pressed contact with an outer circumferential surface of the develop roller 31, owing to the elastic force of the base portion of the blade 32.

As the supply roller 33 is rotated, the toner discharged from the toner outlet 37 is supplied to the develop roller 31, while being positively charged because of friction caused between the supply roller 33 and the develop roller 31. In addition, as the develop roller 31 is rotated, the toner supplied to the develop roller 31 passes between the press portion 40 of the layer-thickness limiting blade 32, and the outer surface of the develop roller 31, so that a toner layer having a pre-selected thickness is formed on the develop roller 31.

The drum cartridge 26 includes a cartridge frame 51; the photosensitive drum 27 as the image carrier that is provided in the cartridge frame 51; a Scorotron type charging device 29; a cleaning brush 52; and the transfer roller 30 as the transferring device.

The cartridge frame 51 is detachably attached to the housing 2, and includes an upper cover member 53 that is located above a sheet feeding path along which each recording sheet 3 is fed and that covers the photosensitive drum 27, the Scorotron type charging device 29, and the cleaning brush 52; and a lower cover member 54 that is located below the sheet feeding path and covers the transfer roller 30.

The photosensitive drum 27 is opposed to the develop roller 31, and is supported by the upper cover member 53 such that the drum 27 is rotatable in a direction (i.e., a clockwise direction) indicated by an arrow. The photosensitive drum 27 includes a drum body that is grounded, and a photosensitive surface layer that is formed of, e.g., polycarbonate and is chargeable to be electrically positive.

The Scorotron type charging device 29 is fixed to the upper cover member 53, such that the charging device 29 is located above, and is opposed to, the photosensitive drum 27, and is spaced from the drum 27 by a pre-selected distance so as not to contact the same 27. The charging device 29 is of a Scorotron type that produces a corona discharge from a charging wire such as a tungsten wire and electrically positively charges an object. In the present embodiment, the charging device 29 charges the surface layer of the photosensitive drum 27 so as to be uniformly positive.

The cleaning brush 52 is opposed to the photosensitive drum 27, on a downstream side of the transferring position, and on an upstream side of the Scorotron type charging device 29, in a direction of rotation of the drum 27, such that the brush 52 is held in contact with the outer surface of the drum 27.

Figure 2:
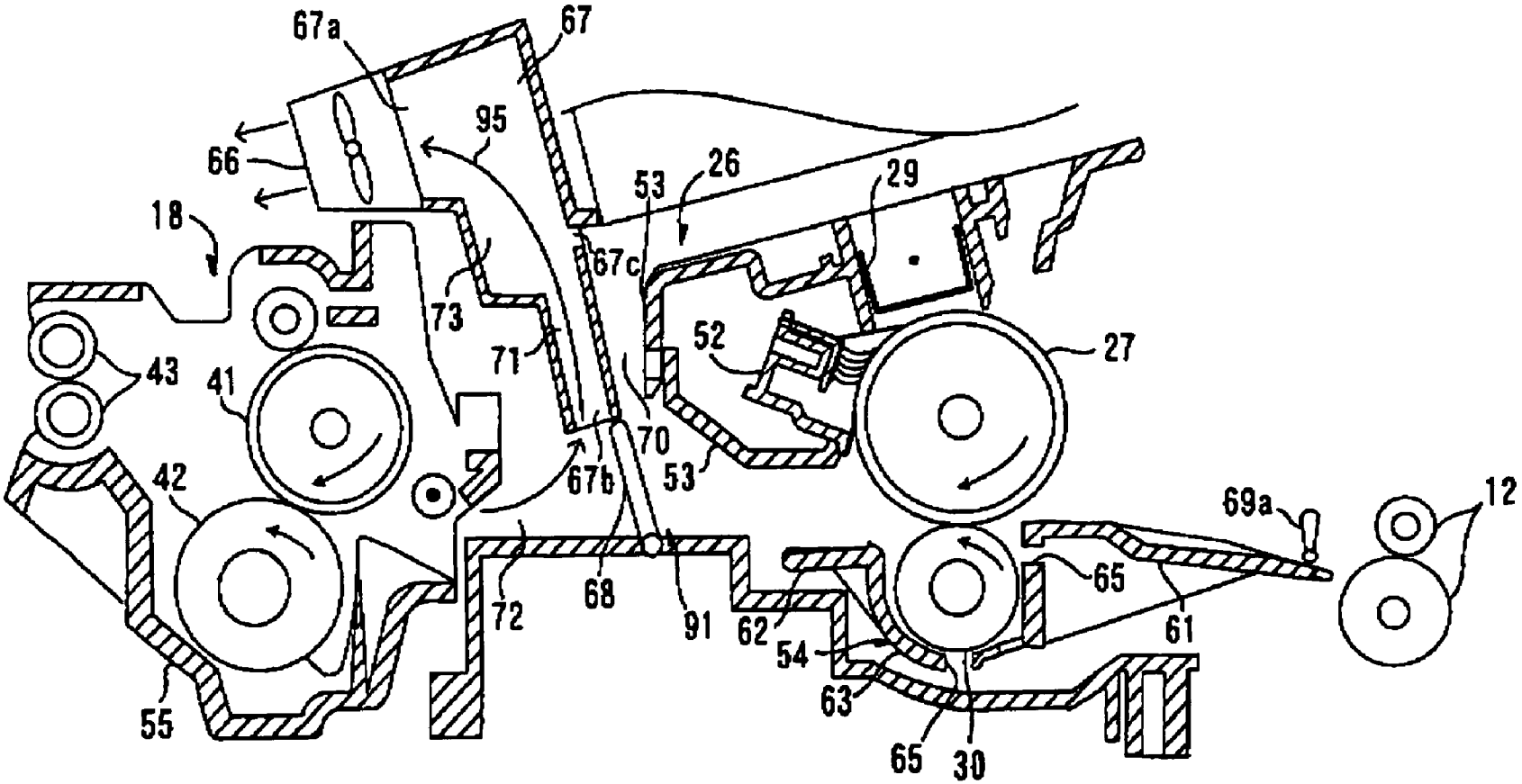
FIG. 2 is an enlarged view of a portion of the laser printer of FIG. 1, showing a first state in which a shutter member is kept at its closed position and an electric fan is rotated at a low speed in an air discharging direction.

As shown in FIG. 2, the lower cover member 54 includes a front guide plate 61 and a rear guide plate 62 each of which has a generally flat shape and extends in frontward and rearward directions, respectively; and a recessed portion 63 that is provided between the front and rear guide plates 61, 62, is integral with the same 61, 62, and is recessed in a downward direction.

The front and rear guide plates 61, 62 guide each recording sheet 3 in front of, and in rear of, the transferring position, respectively, as will be described later.

The recessed portion 63 has a generally U-shaped cross section that opens upward, and accommodates the transfer roller 30 extending in a widthwise direction thereof perpendicular to the sheet feeding direction. More specifically described, the recessed portion 63 covers front, rear, and bottom sides of the transfer roller 30. The recessed portion 63 has two elongate air-flow holes 65.

Figure 7A:
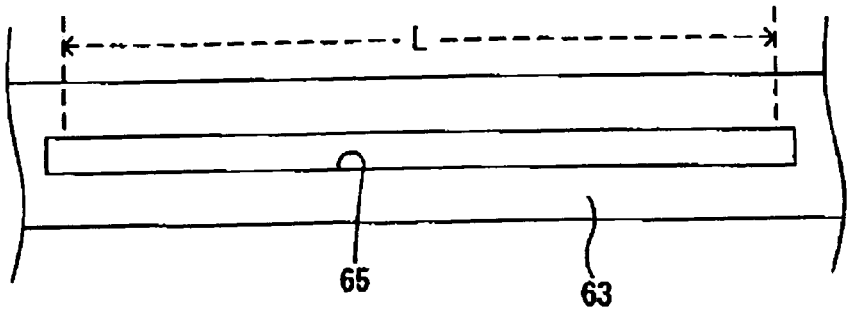
FIG. 7A is a view of an air-flow hole in the form of an elongate slit having a rectangular shape.

As shown in FIG. 7A, each of the two air-flow holes 65 of the recessed portion 63 is elongate in the widthwise direction of the transfer roller 30, and communicates between an inner side of the portion 63 that is opposed to the transfer roller 30 and an outer side of the portion 63 that is opposite to the inner side. The recessed portion 63 can be divided into an upstream-side portion and a downstream-side portion in a direction of rotation of the transfer roller 30, with respect to the transferring position where the photosensitive drum 27 and the transfer roller 30 engage each other. One of the two air-flow holes 65 is located in the upstream-side portion of the recessed portion 63, i.e., in a front-side portion of the same 63; and the other air-flow hole 65 is located around the boundary between the upstream-side and downstream-side portions of the recessed portion 63, i.e., right below the transfer roller 30. As shown in FIG. 7A, each air-flow hole 65 is somewhat longer than an axial length, L, of the transfer roller 30, i.e., a length of the same 30 in the widthwise direction, and is opposed to the entire axial length of the same 30. That is, each air-flow hole 65 is given in the form of an elongate slit that has a substantially rectangular shape and is formed through the thickness of the recessed portion 63.

Figure 7B:
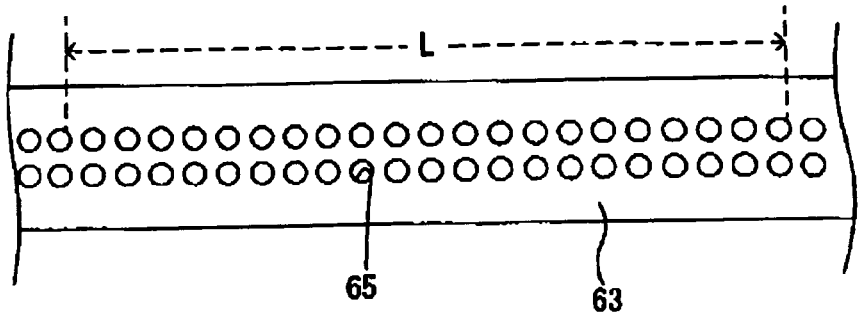
FIG. 7B is a view of a plurality of air-flow holes in the form of circular holes arranged in two arrays in a widthwise direction of a transfer roller.
Figure 7C:
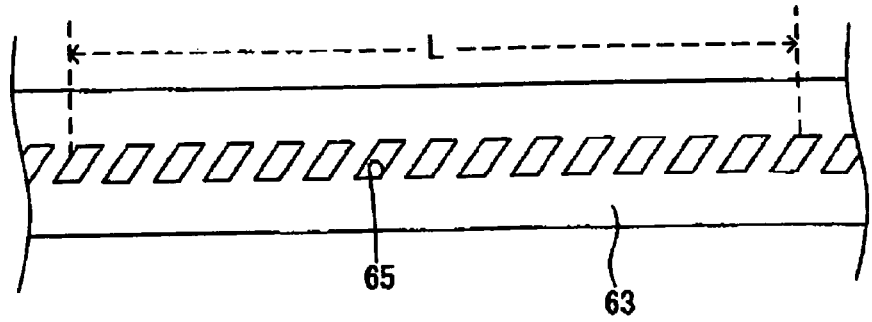
FIG. 7C is a view of a plurality of air-flow holes in the form of quadrangular holes arranged at a regular interval of distance in a widthwise direction of a transfer roller.

However, the shape of each air-flow hole 65 is not limited. For example, as shown in FIG. 7B, each air-flow hole 65 may be replaced with a plurality of circular or round holes 165 that are arranged in a plurality of (e.g., two) arrays in the widthwise direction; or alternatively, as shown in FIG. 7C, each air-flow hole 65 may be replaced with a plurality of quadrangular holes 265 that are arranged at a pre-selected interval of distance in the widthwise direction.

The transfer roller 30 is located under the photosensitive drum 27, such that the roller 30 is opposed to the drum 27, more specifically described, the roller 30 and the drum 27 are held in pressed contact with each other The transfer roller 30 is an ion-conductive transfer roller, and includes a metallic axis portion, and a roller portion that is formed of an ion-conductive rubber material obtained by addition of an ionic substance and covers the axis portion. The transfer roller 30 is supported by the recessed portion 63, such that the roller 30 is rotatable in a direction indicated by an arrow, i.e., a counterclockwise direction.

Figure 5:
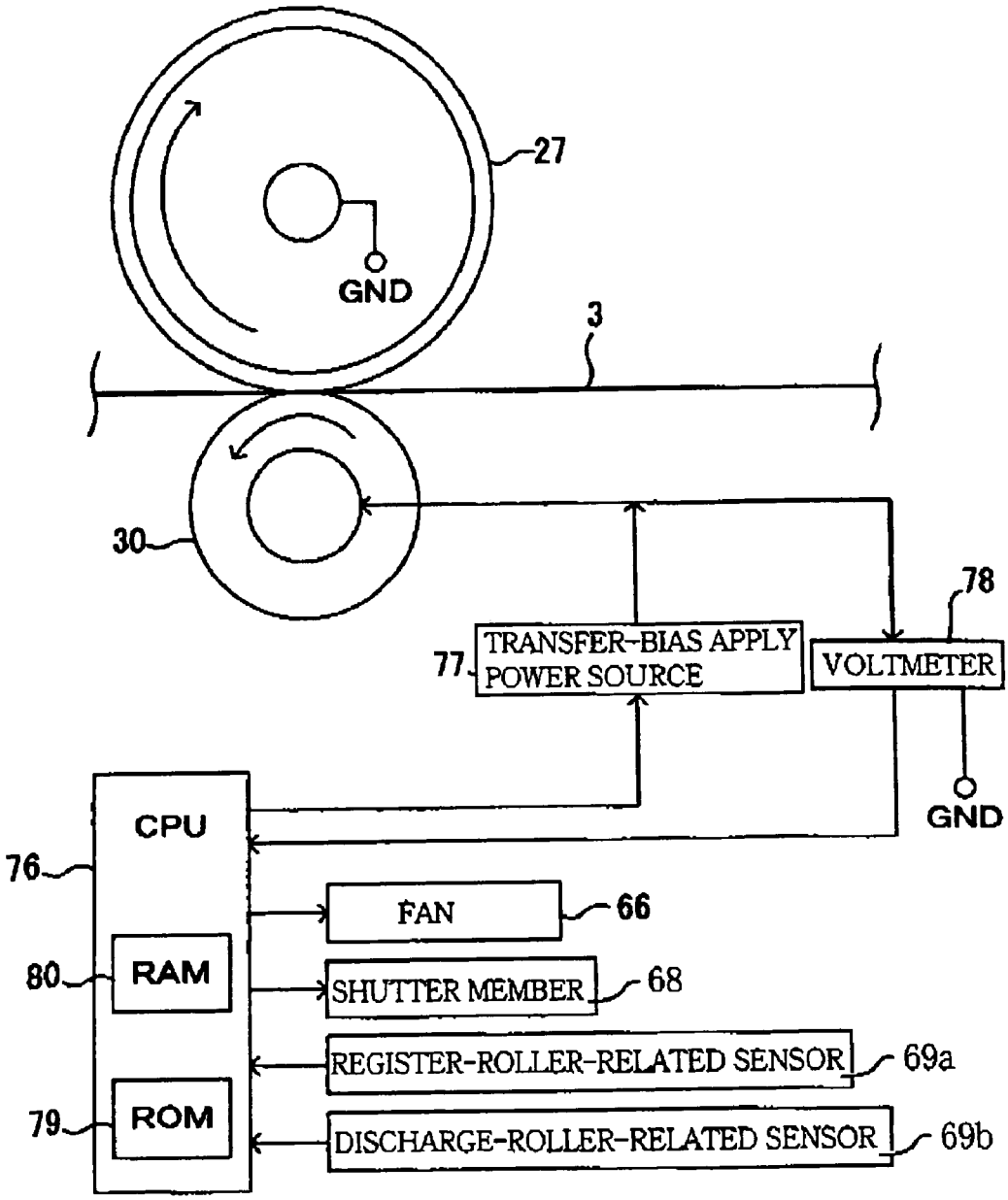
FIG. 5 is a diagrammatic view showing a control system of the laser printer that carries out an air-flow-direction changing program.

As shown in FIG. 5, the metallic axis portion of the transfer roller 30 is connected to a transfer-bias apply power source 77 that can apply, under a constant current control, a transferring bias having a pre-selected electric current, to the axis portion of the roller 30.

In addition, as shown in FIG. 5, a voltmeter 78 as a resistance-related-value measuring device is connected to an electric circuit that connects between the transfer-bias apply power source 77 and the axis portion of the transfer roller 30. The voltmeter 78 measures, under control of a CPU (central processing unit) 76 as a control device, an electric voltage that is generated when the power source 77 applies a pre-selected transfer current as a measurement current, to the axis portion of the transfer roller 30, and supplies the measured electric voltage to the CPU 76. The CPU 76 utilizes, as a parameter occurring to an air-flow-direction changing program that will be described later, the thus supplied electric voltage that is an index of a resistance value of the transfer roller 30.

The transfer roller 30 is driven or rotated in the direction (i.e., the counterclockwise direction) indicated by the arrow, by an electric motor, not shown, Back to FIG. 1 showing the state in which the processing unit 17 is attached to the housing 2, as the photosensitive drum 27 is rotated, the outer surface of the drum 27 is electrically charged to be uniformly positive, by the Scorotron type charging device 29, and then the outer surface of the drum 27 is exposed to the laser beam emitted by the scanning unit 16, so that electrostatic latent images corresponding to the image data are formed in the outer surface of the drum 27. As the drum 27 is further rotated, the toner that is carried on the develop roller 31 and is electrically charged to be positive is supplied, owing to the rotation of the develop roller 31 held in contact with the drum 27, onto the electrostatic latent images formed on the drum 27, i.e., the exposed portions of the outer surface of the drum 27 the electric potential of which has been lowered by the laser beam. Thus, toner images as developing-material images are formed on the drum 27. The toner images are reversed images.

Then, when the recording sheet 3 is fed between the photosensitive drum 27 and the transfer roller 30, the toner images carried on the outer surface of the drum 27 are transferred, owing to the transfer bias applied to the roller 30, onto the sheet 3. The recording sheet 3 carrying the toner images is fed to the fixing portion 18. On the other hand, the toner remaining on the drum 27 after the transferring of the toner images are cleaned off by the cleaning brush 52.

As shown in FIG. 1, the fixing portion 18 is located near to the processing device 17, on a downstream side of the same 17 in the sheet feeding direction. The fixing portion 18 includes a frame 55, a heat roller 41, a press roller 42 that is pressed on the heat roller 41, and a pair of feed rollers 43 that are located on a downstream side of the heat and press rollers 41, 42.

The heat roller 41 is formed of a metal, is provided with a halogen lamp as a heat generating member, and is driven or rotated in a direction indicated by an arrow, i.e., a clockwise direction, by an electric motor, not shown.

The press roller 42 is located under the heat roller 41, such that the press roller 42 is held in pressed contact with the heat roller 41. The press roller 42 is rotated in a direction indicated by an arrow, i.e., a counterclockwise direction so as to follow the rotation of the heat roller 41.

While the recording sheet 3 carrying the toner images transferred by the processing unit 17 is fed between the heat roller 41 and the press roller 42, the fixing portion 18 thermally fixes the toner images on the recording sheet 3. Then, the recording sheet 3 is fed by the feed rollers 43, to a sheet discharging path 44. The sheet 3 fed to the path 44 is further fed by sheet discharge rollers 45 into a sheet collect tray 46.

The present laser printer 1 employs a sheet reversing and feeding portion 47, for the purpose of forming images on opposite surfaces of each recording sheet 3. The reversing and feeding portion 47 includes the sheet discharge rollers 45, a reverse and feed path 48, a flapper 49, and a plurality of pairs of reverse and feed rollers 50.

The sheet discharge rollers 45 consist of a pair of rollers, and are selectively rotatable in a forward direction and an opposite or backward direction. When the recording sheet 3 is discharged onto the sheet collect tray 3 as described above, the discharge rollers 45 are rotated in the forward direction; and when the sheet 3 is reversed, the rollers 45 are rotated in the opposite direction.

The reverse and feed path 48 feeds the recording sheet 3 from the sheet discharge rollers 45, down to the reverse and feed rollers 50 located below the transferring position To this end, the path 48 is elongate in upward and downward directions, such that an upstream-side end of the path 48 is located in the vicinity of the sheet discharge rollers 45 and a downstream-side end of the same 48 is located in the vicinity of the reverse and feed rollers 50.

The flapper 49 is provided at a location where the sheet discharge path 44 and the reverse and feed path 48 are bifurcated from each other, such that the flapper 49 is pivotable. Depending on whether a solenoid, not shown, is energized or deenergized, the flapper 49 is switched between a first position where the flapper 49 allows the recording sheet 3 to be fed by the sheet discharge rollers 45, forward in the sheet discharge path 44, and a second position where the flapper 49 allows the sheet 3 to be fed by the rollers 45, backward in the reverse and feed path 48.

The reverse and feed rollers 50 consist of a plurality of pairs of rollers that are located above the sheet supply tray 6 and are arranged in a horizontal direction. The most upstream pair of rollers 60 are located in the vicinity of the downstream-side end of the reverse and feed path 48; and the most downstream pair of rollers 50 are located below the register rollers 12.

In the case where images are formed on opposite surfaces of a recording sheet 3, the reversing and feeding portion 47 is operated as follows: When the recording sheet 3 on one surface of which images have been formed is fed by the feed rollers 43 from the sheet discharge path 44 to the sheet discharge rollers 45, the sheet discharge rollers 45 are rotated in the forward direction while pinching the sheet 3, so that the sheet 3 is fed outward, i.e., toward the sheet collect tray 46. When almost all portions of the sheet 3 are fed outward and the trailing end of the sheet 3 is pinched by the rollers 45, the forward rotation of the rollers 45 is stopped. Then, the rollers 46 are rotated in the backward direction, and the flapper 49 is switched from the first position to the second position, so that the sheet 3 is fed backward, i.e., toward the reverse and feed path 48 while the above-indicated trailing end of the sheet 3 "leads" the same 3. After the backward feeding of the sheet 3 is finished, the flapper 49 is returned from the second position to the first position, so as to allow another recording sheet 3 fed from the feed rollers 43 to be fed to the sheet discharge rollers 45. Subsequently, the sheet 3 fed backward to the reverse and feed path 48 is further fed to the reverse and feed rollers 50, and the direction of feeding of the sheet 3 is changed upward and then forward. Thus, the sheet 3 is inverted, and is fed to the register rollers 12. After the inverted sheet 3 is again registered by the register rollers 12, the sheet 3 is fed to the image forming position, so that images are also formed on the opposite surface of the sheet 3. Thus, the sheet 8 has images on each of the two opposite surfaces thereof.

The present laser printer 1 additionally employs an electric fan 66 as an air-flow-direction changing device; an air duct 67 that guides an air flow toward the fan 66; a shutter member 68; a register-roller-related sensor 69*a* as a sheet feeding detector; and a discharge-roller-related sensor 69*b*.

Each recording sheet 3 is fed along an intermediate feed path 91 from the transferring position where the photosensitive drum 27 and the transfer roller 30 engage each Other, to the fixing position where the heat roller 41 and the press roller 42 engage each other. The fan 66 is located above the intermediate feed path 91, more specifically described, above the frame 55 and below the sheet collect tray 46. The fan 66 is rotatable about an axis line parallel to the frontward and rearward directions, so that air flows are generated in those directions. An air duct, not shown, opens, in the housing 2, at a position in the vicinity of the fan 66, so that the air in the housing 2 can be discharged through the air duct, and ambient air in an outside space can be taken into the housing 2.

The electric fan 66 is rotatable, under control of the CPU 76, described later, in a forward direction, i.e., an air taking direction to take the ambient air through the air duct, and a backward direction, i.e., an air discharging direction to discharge the air from the housing 2 through the air duct. When the fan 66 is rotated in the air discharging direction, the fan 66 can be rotated in two speed steps, i.e., a low speed and a high speed that is from 50% to 100% higher than the low speed. The low speed is selected when the laser printer 1 is operated in a normal manner; and the high speed is selected when air is forcedly discharged from the housing 2.

The air duct 67 has a cylindrical, hollow shape, is provided between the processing unit 17 and the fixing portion 18 in the housing 2, and extends in upward and downward directions such that an upper open end 67*a* of the duct 67 opens rearward so as to communicate with the fan 66 and a lower open end 67*b* of the same 67 opens downward so as to communicate with the intermediate feed path 91.

A front wall of the air duct 67 includes an upper portion that contacts the scanning unit 16, and a lower portion that is spaced from the processing unit 17 by a pre-selected distance, and the duct 67 has a side opening 67*c* that is located between the upper and lower portions of the front wall and has a substantially rectangular shape elongate in the widthwise direction.

Since the air duct 67 is constructed as described above, the present laser printer 1 has, as shown in FIG. 2, two air-flow passages, i.e., a first air-flow passage 72 that extends from the transferring position to the fixing position and coincides with the intermediate feed path 91, and a second air-flow passage 73 that extends from the electric fan 66, via the air duct 67, to an intermediate connection point of the first air-flow passage 72 that is located between the processing unit 17 and the fixing portion 18. The second air-flow passage 73 includes, in a lower portion of the duct 67, a rear passage 71 that extends in rear of the front wall of the duct 67, i.e., inside the duct 67; and a front passage 72 that extends in front of the front wall of the duct 67, i.e., between the duct 67 and the processing unit 17.

The second air-flow passage 73 provided between the electric fan 66 and the intermediate connection point of the first air-flow passage 72, is inclined relative to the first passage 72, such that the second passage 73 cooperates with a fixing-portion-side portion of the first passage 72 that is located on a fixing-portion side of the intermediate connection point of the first passage 72, to have an acute angle.

The shutter member 68 is provided in a portion of the intermediate feed path 91 that is located right below the air duct 67, i.e., the connection point of the first air-flow passage 72 to which the second air-flow passage 73 connected. The shutter member 68 has a generally rectangular plate-like shape extending in the widthwise direction, and a lower end portion of the shutter member 68 is pivotally supported by the housing 2, such that the shutter member 68 is movable upward and downward. The shutter member 68 is connected to a solenoid, not shown, and, when the solenoid is energized or deenergized under control of the CPU 76, described later, the shutter member 68 is pivotable to an open position (FIG. 3) where the shutter 68 is tilted down to be parallel to the intermediate feed path 91, and to a closed position (FIG. 2) where the shutter 68 is tilted up to be aligned with the front wall of the lower open end 67*b* of the air duct 67 such that substantially no space is left between the shutter 68 and the front wall.

Figure 3:
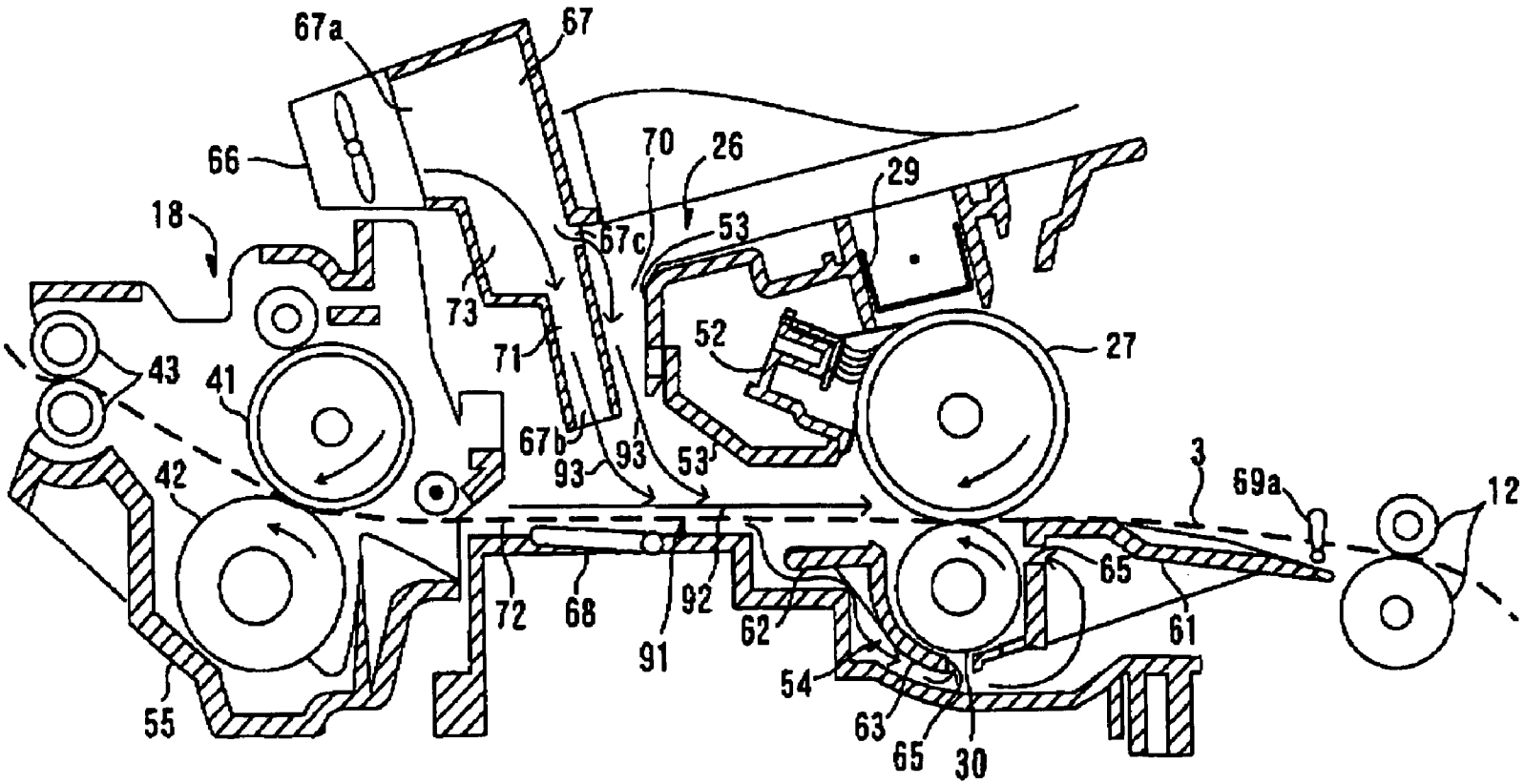
FIG. 3 is an enlarged view of the portion of the laser printer of FIG. 1, showing a second state in which the shutter member is kept at its open position and the fin is rotated in an air taking direction.
Figure 4:
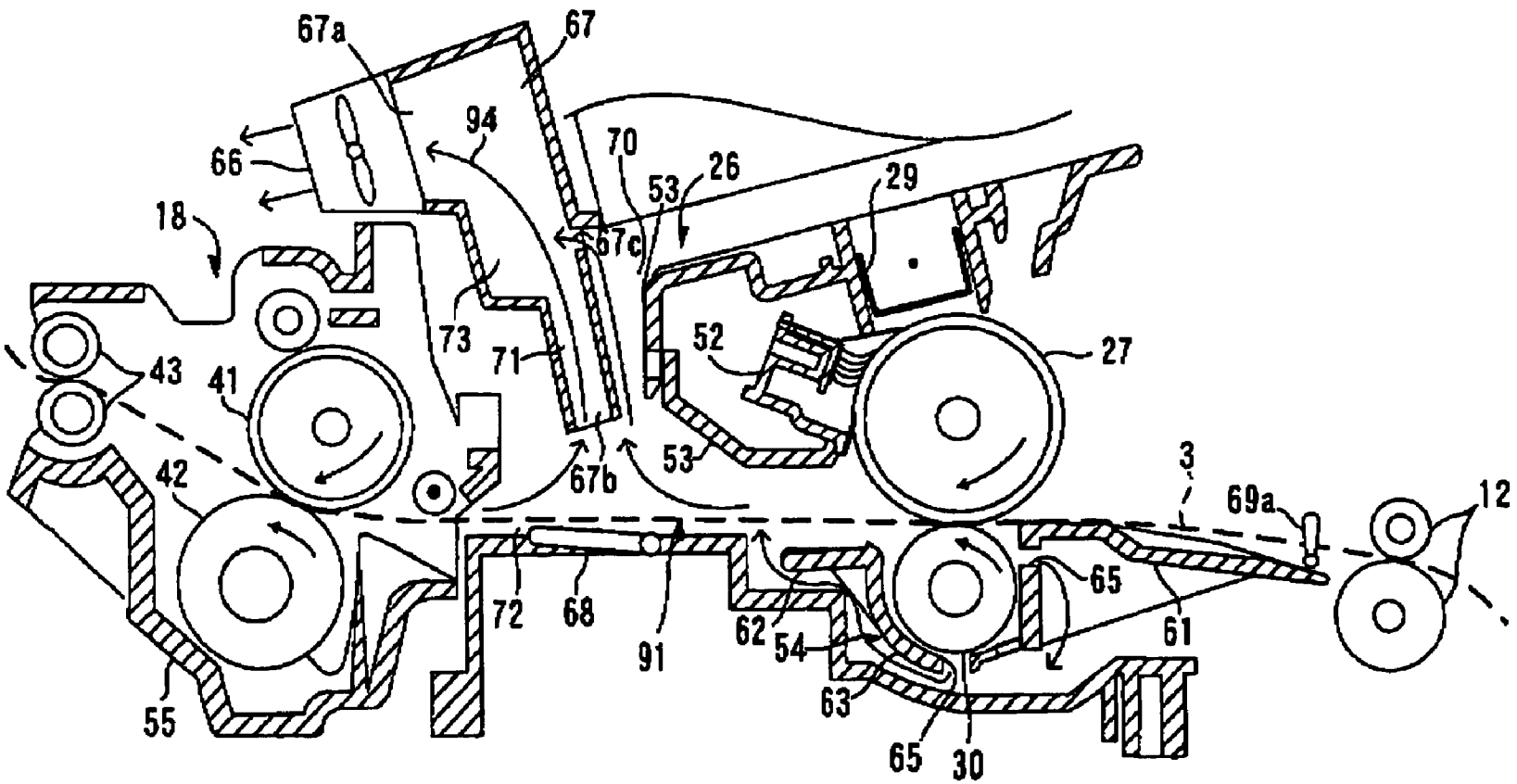
FIG. 4 is an enlarged view of the portion of the laser printer of FIG. 1, showing a third state in which the shutter member is kept at its open position and the fan is rotated at a high speed in the air discharging direction.

As shown in FIGS. 3 and 4, in the state in which the shutter member 68 is kept at the open position, the first air-flow passage 72 is opened, and air is allowed to flow between the transferring position and the fixing position; and, as shown in FIG. 2, in the state in which the shutter member 68 is kept at the closed position where the shutter 68 is substantially continuous with the front wall of the air duct 67, the first air-flow passage 72 is closed, and air is inhibited from flowing between the transferring position and the fixing position.

Irrespective of whether the shutter member 68 may be kept at the closed position or the open position, air is always allowed to flow from the transferring position to the electric fan 66 via a front portion of the first air-flow passage 72 (i.e., a portion of the passage 72 that is located between the transferring position and the connection point of the passage 72 to which the second air-flow passage 73 is connected), the front passage 70 of the second passage 73, and an upper portion of the second passage 73 (i.e., a portion of the passage 73 that is located between the fan 66 and the point where the front and rear passages 70, 71 are bifurcated from each other), and is also allowed to flow from the fixing position to the fan 66 via a rear portion of the first passage 72 (i.e., the fixing-portion side portion of the passage 72 that is located between the fixing position and the connection point to which the second passage 73 is connected), the rear passage 71 of the second passage 73, and the above-indicated upper portion of the second passage 73.

For example, FIG. 3 shows the case where the CPU 76 controls the shutter member 68 to be kept at the open position and controls the fan 66 to be rotated in the air taking direction. In this case, there are generated a first air flow 92, i.e., air that is heated by the fixing portion 18 and is directed from the fixing position toward the transferring position in the first air-flow passage 72, and a second air flow 98, i.e., ambient air that is taken by the fan 66 to promote the first air flow 92 and is directed from the fan 66 toward the first passage 72 via the upper portion of the second air-flow passage 73 and the rear and front passages 71, 70 of the second passage 73.

Thus, all the air flows produced in the housing 2 can be used to convey the heat generated by the fixing portion 18 to locations around the transfer roller 30 and thereby increase the temperature of air around the roller 30, i.e., increase the temperature of the roller 30. Those air flows will be referred to as first-direction air flows as temperature-increasing air flows.

On the other hand, FIG. 4 shows the case where the CPU 76 controls the shutter member 68 to be kept at the open position and controls the fan 66 to be rotated at the high speed in the air discharging direction. In this case, there is generated, against the first air flow 92, a third air flow 94 that includes air that is heated by the fixing portion 18 and is directed from the fixing position toward the fan 66 via the rear portion of the first air-flow passage 72, the rear and front passages 71, 70 of the second air-flow passage 73, and the upper portion of the second passage 73. The third air flow 94 additionally includes air that is present around the transferring position and is directed from the transferring position toward the fin 66 via the front portion of the first passage 72, the rear and front passages 71, 70 of the second passage 73, and the upper portion of the second passage 73.

Thus, all the air flows produced in the housing 2 can be used to discharge the heat generated by the fixing portion 18, and the air around the transferring roller 30, into the outside space through the fan 66 and thereby decrease the temperature of air around the roller 30, i.e., decrease the temperature of the roller 30. Those air flows will be referred to as second-direction air flows as temperature-decreasing air flows.

In addition, FIG. 2 shows the case where the CPU 76 controls the shutter member 68 to be kept at the open position and controls the fan 66 to be rotated at the low speed in the air discharging direction. In this case, there are generated, in place of the first air flow 92, a fourth air flow 95, i.e., air that is heated by the fixing portion 18 and is directed from the fixing position toward the fan 66 via the rear portion of the first passage 72, the rear passage 71 of the second passage 73, and the upper portion of the second passage 73.

In the case shown in FIG. 2, there is also generated a small air flow, not shown, i.e., air that is present around the transferring position and is directed from the transferring position to the fan 66 via the front portion of the first passage 72, the front passage 70 of the second passage 73, and the upper portion of the second passage 73. However, this small air flow does not influence the temperature of the air around the transfer roller 30.

Thus, all the air flows produced in the housing 2 can be used to discharge the heat generated by the fixing portion 18 into the outside space through the fan 66, without influencing the temperature of the air around the roller 30, i.e., the temperature of the roller 30.

The register-roller-related sensor 69*a* is located on a downstream side of the register rollers 12, and on an upstream side of the transferring position, in the sheet feeding direction, and is supported by the front guide plate 61 of the lower cover member 54. The sensor 69*a* includes a pivotable sensing member. When a recording sheet 3 is fed from the register rollers 12 and the leading end of the sheet 3 engages the sensing member of the sensor 69*a*, the sensing member is tilted down and the sensor 69*a* outputs an ON signal; and when the trailing end of the sheet 3 is disengaged from the sensing member, the sensing member is tilted up and the sensor 69*a* outputs an OFF signal. The sensor 69*a* supplies the ON and OFF signals to the CPU 76. When the CPU 76 receives the ON signal, and then the OFF signal, from the sensor 69*a*, the CPU 76 recognizes that a recording sheet 3 is being fed from the transferring position to the fixing position.

As shown in FIG. 1, the discharge-roller-related sensor 69*b* is located on a downstream side of the fixing portion 18, and on an upstream side of the sheet discharge rollers 45, in the sheet feeding direction, and is supported by the housing 2. Like the register-roller-related sensor 69*a*, the sensor 69*b* includes a pivotable sensing member. When a recording sheet 3 is fed from the feed rollers 43 and the leading end of the sheet 3 engages the sensing member of the sensor 69*b*, the sensing member is tilted down and the sensor 69*b* outputs an ON signal; and when the trailing end of the sheet 3 is disengaged from the sensing member, the sensing member is tilted up and the sensor 69*b* outputs an OFF signal. The sensor 69*b* supplies the ON and OFF signals to the CPU 76. When the CPU 76 receives the ON signal, and then the OFF signal, from the sensor 69*b*, the CPU 76 recognizes that a recording sheet 3 is being discharged from the laser printer 1.

In the laser printer 1, it is needed to quickly increase or decrease the temperature of air around the transfer roller 30, i.e., the temperature of the roller 30, and thereby perform stable transferring of toner images. To this end, first, the voltmeter 78 measures an electric voltage from the transfer roller 30 when a measurement current is applied to the same 30. The measured voltage is used as an index of a current resistance value of the transfer roller 80. More specifically described, based on the measured voltage, the CPU 76 controls the direction and speed of rotation of the electric fan 66, and the opening and closing of the shutter member 68, according to the air-flow-direction changing program.

The air-flow-direction changing program is carried out by the control system of the laser printer 1, shown in FIG. 5.

As shown in FIG. 5, the control system includes the electric fan 66, the shutter member 68, the register-roller-related sensor 69*a*, the discharge-roller-related sensor 69*b*, the transfer bias apply power source 77, and the voltmeter 78 each of which is connected to the CPU 76.

The CPU 76 includes a ROM (read only memory) 79 and a RAM (random access memory) 80, and controls each of the above-indicated elements. The ROM 79 stores a printing-operation control program incorporating the above-indicated air-flow-direction changing program, and pre-set low-resistance-related and high-resistance-related threshold values used in the air-flow-direction changing program.

The RAM 80 temporarily stores electric signals supplied from various sensors including the register-roller-related sensor 69*a* and the discharge-roller-related sensor 69*b*, and various measured values including the resistance-related value (i.e., the measured voltage) supplied from the voltmeter 78.

Next, there will be described the printing control program incorporating the air-flow-direction changing program, by reference to the flow chart shown in FIG. 6.

Here, it is noted that when the laser printer 1 is not performing a printing operation, i.e., the CPU 76 is not implementing the printing control program, the electric fan 66 is not rotated and the shutter member 68 is kept at the closed position.

When the CPU 76 receives a printing job, the CPU 76 starts implementing the printing control program. First, at Step S1, the transfer-bias apply power source 77 applies a measurement current to the transfer roller 30. The measurement current is, e.g., −12 μA. Subsequently, at Step S2, the voltmeter 78 measures an electric voltage of the transfer roller 30, and supplies the measured voltage as an index of a current resistance value of the roller 30, to the CPU 76. Since the measured voltage is a resistance-related value related to the current resistance of the transfer roller 30, Step S2 is a resistance-related-value obtaining step.

Then, at Step S3, the CPU 76 judges whether an absolute value of the measured voltage is lower than, or equal to, the pre-set high-resistance-related threshold value, i.e., whether the current resistance of the transfer roller 30 is lower than, or equal to, a high-resistance threshold value. A voltage corresponding to the pre-set high-resistance-related threshold value is, e.g., −6 kV.

If a negative judgment (NO) is made at Step S3, i.e., if the temperature of air around the transfer roller 30 is too low and accordingly the current resistance of the transfer roller 30 is higher than the high-resistance threshold value, the control of the CPU 76 goes to Step S4 to pivot the shutter member 68 downward to its open position, and then to Step S5 to rotate the electric fan 66 in the air taking direction. Thus, Step S4 is a shutter-member control step; and Step S5 is a first-direction-air-flow producing step. Thus, as described above by reference to FIG. 3, the first air flow 92, and the second air flow 93 that promotes the first air flow 92, that is, the temperature-increasing air flows are produced. In more detail, the first air flow 92 that is the flow of the air heated by the heating portion 18 is promoted by the second air flow 93, so that the promoted first air flow 92 is seat to the locations around the transfer roller 30. Thus, the temperature of the air around the transfer roller 30, i.e., the temperature of the roller 30 is increased, and accordingly the resistance of the roller 30 is lowered.

In particular, since the processing unit 17 employs the lower cover member 54 including the recessed portion 63 having the air-flow holes 65, the air outside the recessed portion 63 can be introduced into the inner space of the recessed portion 63 through the air-flow holes 65, as shown in FIG. 3. Thus, the temperature of the air around the transfer roller 30 can be quickly increased and therefore can be easily and reliably adjusted. In addition, since the air-flow holes 65 extend over the entire axial length of the transfer roller 30, the temperature of the air around the entire axial length of the roller 30 can be substantially uniformly adjusted. Moreover, since the recessed portion 63 has the two air-flow holes 65 located in front of, and right below, the transfer roller 30, respectively, the recessed portion 63 can prevent the roller 30 from directly receiving the radiant heat of the fixing portion 18, and can also prevent the air from resting around the roller 30. Thus, the temperature of the air around the transfer roller 30, i.e., the temperature of the roller 30 can be controlled with high accuracy.

Steps S1 through S5 are repeated till the resistance corresponding to the voltage measured by the voltmeter 78 is lowered to below the high-resistance threshold value.

On the other hand, if a positive judgment (YES) is made at Step S3, i.e., if the resistance corresponding to the measured voltage is lower than, or equal to, the high-resistance threshold value, the temperature of the air around the transfer roller 30 is not too low, and the resistance of the roller 30 may be within the range assuring that the roller 30 can stably transfer toner images. Hence, the control of the CPU 76 goes to Step S6 to judge whether the absolute value of the measured voltage is higher than, or equal to, the pre-set low-resistance-related threshold value, i.e., whether the current resistance of the transfer roller 30 is higher than, or equal to, a low-resistance threshold value. A voltage corresponding to the pre-set low-resistance-related threshold value is, e.g., −0.1 kV.

If a negative judgment (NO) is made at Step S6, i.e., if the temperature of air around the transfer roller 30 is too high and accordingly the current resistance of the roller 30 is lower than the low-resistance threshold value, the control of the CPU 76 goes to Step S7 to pivot the shutter member 68 down to its open position, and then to Step S8 to rotate the fan 66 at the high speed in the air discharging direction Step S7 is another shutter-member control step; and Step S8 is a second-direction-air-flow producing step. Thus, as described above by reference to FIG. 4, the third air flow 94 against the first air flow 92, i.e., the temperature-decreasing air flow is produced. In more detail, the third air flow 94 prevents the first air flow 92 that is the flow of the air heated by the heating portion 18, from flowing toward the transfer roller 30, and additionally promotes the warm air around the roller 30 to be sent toward the electric fan 66. Thus, the temperature of the air around the transfer roller 30 is decreased, and accordingly the resistance of the roller 30 is increased.

In particular, since the processing unit 17 employs the lower cover member 54 including the recessed portion 63 having the air-flow holes 65, the air inside the recessed portion 63 can be discharged to the outer space of the recessed portion 63 through the airflow holes 65, as shown in FIG. 4. Thus, the temperature of the air around the transfer roller 30 can be quickly decreased and therefore can be easily and reliably adjusted. In addition, since the air-flow holes 65 extend over the entire axial length of the transfer roller 30, the temperature of the air around the entire axial length of the roller 30 can be substantially uniformly adjusted. Moreover, since the recessed portion has the two air-flow holes 66 located in front of, and right below, the transfer roller 30, respectively, the recessed portion 63 can prevent the roller 30 from directly receiving the radiant heat of the filing portion 18, and can also prevent the air from resting around the roller 30. Thus, the temperature of the air around the transfer roller 30, i.e., the temperature of the roller 30 can be controlled with high accuracy.

Steps S1 through S8 are repeated till the resistance corresponding to the voltage measured by the voltmeter 78 exceeds the low-resistance threshold value.

On the other hand, if a positive judgment (YES) is made at Step S6, i.e., if the resistance corresponding to the measured voltage is higher than, or equal to, the low-resistance threshold value, the temperature of the air around the transfer roller 30 is not too high, and the resistance of the roller 30 is within the range assuring that the roller 30 can stably transfer toner images. Hence, the control of the CPU 76 goes to Step S9 to rotate the fan 66 at the low speed in the air discharging direction, while the shutter member 68 is kept at its closed position.

Thus, as described above by reference to FIG. 2, the fourth air flow 96 is produced in the state in which the shutter member 68 is kept at the closed position. In more detail, the air heated by the heating portion 18 is discharged through the fan 66, and accordingly the temperature of the air around the transfer roller 30 is prevented from being influenced by the heat generated by the heating portion 18.

Then, the control of the CPU 76 goes to Step 10 to start a printing operation corresponding to the printing job supplied thereto. Then, at Step S11, recording sheets 3 are fed one by one from the sheet feed tray 7 to the register rollers 12 and, when the leading end of each recording sheet 3 fed by the register rollers 12 engages the register-roller-related sensor 69*a*, the sensor 69*a* supplies an ON signal to the CPU 76. In addition, when the trailing end of the sheet 3 leaves the sensor 69*a*, the sensor 69*a* supplies an OFF signal to the CPU 76. Thus, the CPU 76 recognizes that a recording sheet 3 is being fed from the transferring position toward the fixing position.

Then, at Step S12, the shutter member 68 is tilted up to the open position. Step S12 is another shutter-member control step. Next, at Step S13, the recording sheet 3 to which toner images have been transferred is fed to the intermediate feed path 91, and the toner images are fixed by the fixing portion 18. When the leading end of the sheet 3 engages the discharge-roller-related sensor 69*b*, the sensor 69*b* outputs an ON signal to the CPU 76; and when the trailing end of the sheet 3 leaves the sensor 69*b*, the sensor 69*b* outputs an OFF signal to the CPU 76. Thus, the CPU 76 recognizes that a recording sheet 3 is being discharged from the laser printer 1.

Then, at Step S14, the CPU 76 judges whether the printing job indicates that the current printing operation should be continued on another recording sheet 3. If a positive judgment (YES) is made at Step S14, the CPU 76 repeats Steps S11 through S14, till a negative judgment (NO) is made at Step S14, i.e., the printing jog indicates that the printing operation should not be continued on any more recording sheets 3.

Meanwhile, if a negative judgment (NO) is made at Step S14, the control of the CPU 76 goes to Step S15 to end the current printing operation, and subsequently to Step S16 to return the shutter member 68 to its closed position. Then, the control of the CPU 76 quits the printing control program.

Thus, in the present laser printer 1, the CPU 76 uses the electric voltage measured by the voltmeter 78, as the index of the electric resistance of the transfer roller 30, i.e., controls, based on the measured voltage, the direction and speed of rotation of the fan 66, thereby changing the direction of flow of air around the roller 30. That is, the CPU 76 can easily control the temperature of the air around the transfer roller 30, such that the temperature corresponds to the electric resistance of the roller 30, i.e., can quickly increase or decrease the temperature of the air by changing the direction of flow of the air. Thus, toner images can be stably transferred by the transfer roller 30, from the photosensitive drum 27 onto each recording sheet 3.

In particular, the laser printer 1 employs the ion-conductive-type transfer roller 30 that is characterized in that variations among individual transfer rollers 30 are small and variations among respective axial portions of each transfer roller 30 are also small. The electric resistance of the ion-conductive-type transfer roller 30 is largely changed by the temperature of the air around the roller 30. However, the CPU 76 can change, under the above-described control the direction of flow of the air around the roller 30, and thereby stabilize the temperature of the air around the roller 30, and therefore minimize the change of electric resistance of the roller 80. Thus, toner images can be transferred with high reliability.

In addition, in the laser printer 1, the transfer-bias apply power source 77 applies the pre-set measurement current to the axis portion of the transfer roller 30, so that the voltmeter 78 can measure the electric voltage of the roller 30 and the CPU 76 can use the thus measured electric voltage as the index of the electric resistance of the roller 30. Thus, the laser printer 1 can enjoy its simple construction and reliable control.

In addition, the laser printer 1 employs the electric fan 66 that is rotatable in each of the two opposite directions, and changes the directions of rotation of the fan 66, for the purpose of changing the directions of flow of the air around the transfer roller 30. Thus, the laser printer 1 can reliably change, with its simple construction, the directions of flow of the air around the roller 30. More specifically described, the CPU 76 can change the directions of rotation of the fan 66, i.e., selectively rotate the fan 66 in the temperature increasing or decreasing direction, and therefore can easily and reliably increase or decrease the temperature of the air around the roller 30. Thus, the transfer roller 30 can stably transfer toner images.

Moreover, since the electric fan 66 is located above the intermediate feed path 91, the fan 66 can efficiently generate the air flows.

In addition, if the electric voltage measured by the voltmeter 78 is higher than the pre-set high-resistance-related threshold value, the CPU 76 controls the fan 66 to be rotated in the air taking direction, so that the air may flow in the temperature increasing direction. On the other hand, if the measured electric voltage is lower than the pre-set low-resistance-related threshold value, the CPU 76 controls the fan 66 to be rotated at the high speed in the air discharging direction, so that the air may flow in the temperature decreasing direction. To this end, the ROM 79 just stores the pre-set high-resistance-related and low-resistance-related threshold values. Thus, the CPU 76 can easily control, and reliably adjust, the temperature of the air around the transfer roller 30.

In the laser printer 1, when the shutter member 68 is moved to the open position, air is allowed to flow between the transferring position and the fixing position. Since, therefore, the first, second, and third air flows 92, 93, 94 are allowed to occur, the temperature of the air around the transfer roller 30 can be controlled to be increased or decreased. On the other hand, when the shutter member 68 is moved to the closed position, air is inhibited from flowing between the transferring position and the fixing position. Since, therefore, the first air flow 92 is inhibited, the temperature of the air around the roller 80 cannot be controlled, i.e., cannot be increased or decreased. Thus, the heat generated by the fixing portion 18 can be prevented from being sent to the transfer roller 30.

In short, when the shutter member 68 is kept at the Open position, the temperature of the air around the transfer roller 30 can be controlled to be increased or decreased; and when the shutter member 68 is kept at the closed position, the heat generated by the fixing portion 18 is prevented from being sent to the roller 30, and accordingly the controlling of the temperature can be temporarily stopped.

According to the above-described air-flow-direction changing program, the shutter member 68 is basically kept at the closed position; and when the measured electric voltage of the transfer roller 30 is higher than the pre-set high-resistance-related threshold value, when the measured electric voltage is lower than the pre-set low-resistance-related threshold value, or when the register-roller-related sensor 69*a* detects the feeding of each recording sheet 3, that is, when the temperature of the air around the transfer roller 30 needs to be changed or when each recording sheet 3 needs to be fed forward, the shutter member 68 is moved to its open position for a controlled time before the discharge-roller-related sensor 69*b* detects that the last one of a plurality of recording sheets 3 to be printed in a printing job has been discharged from the printer 1. Thus, when the temperature of the air around the transfer roller 30 need not be controlled, and when each recording sheet 3 need not be fed, the heat generated by the fixing portion 18 can be inhibited from being sent to around the transfer roller 30, and the temperature of the air around the roller 30 can be reliably prevented from being increased.

In the illustrated embodiment, the shutter member 68 is tilted down and up, i.e., opened and closed by the energization and deenergization of the solenoid (not shown). However, the device for opening and closing the shutter member 68 is not limited to the solenoid. For example, the opening and closing device may be provided by a sliding device that selectively slides a shutter member 68 to its open or closed position. In addition, the shutter member 68 may be attached to a different member than the housing 2. For example, the shutter member 68 may be attached to the cartridge frame 51 of the processing unit 17.

According to the principle of the present invention, the shutter member 68 may be omitted. In the latter case, Steps S4, S7, S12, and S16 are omitted from the flow chart shown in FIG. 6.

In the illustrated embodiment, the lower cover member 54 having the air-flow holes 65 has been described as part of the cartridge frame 51 of the processing unit 17. However, the lower cover member 54 may be provided by part of the housing 2. In the latter case, the lower cover member 54 is fixed to the housing 2, irrespective of whether the processing unit 17 may be attached to, or detached from, the housing 2.

In the illustrated embodiment, one of the two air-flow holes 65 is provided in the front portion of the lower cover member 54 in the direction of rotation of the transfer roller 30. Therefore, when the processing unit 17 is operated with the fixing portion 18 provided on the downstream side of the transfer roller 30, the lower cover member 54 can prevent the transfer roller 30 from directly receiving the heat radiated from the heat roller 41 of the fixing portion 18, and can simultaneously prevent air from dwelling around the transfer roller 80.

In the illustrated embodiment, the other of the two air-flow holes 65 is provided in the central portion of the lower cover member 54 that is located around the boundary between the front and rear portions thereof in the direction of rotation of the transfer roller 30. Therefore, when the processing unit 17 is operated with the fixing portion 18 provided on the downstream side of the transfer roller 30, the lower cover member 54 can prevent the transfer roller 30 from directly receiving the heat radiated from the fixing portion 18, and can simultaneously prevent air from dwelling around the transfer roller 30.

In the illustrated embodiment, the air outside the lower cover member 54 and the air inside the same 54 can be exchanged with each other through the air-flow holes 65 provided along the substantially entire length of the transfer roller 30. Therefore, the temperature of the air around the substantially entire length of the transfer roller 30 can be uniformly adjusted.

In the illustrated embodiment, since the ion-conductive transfer roller 30 is employed, the electric resistance of the transfer roller 30 can largely change depending upon the temperature of the air around the same 30. However, in the present laser printer 1, the voltage of the transfer roller 30 is measured by the voltmeter 78, and the CPU 76 as the control device controls, based on the measured voltage, the electric fan 66 to change the direction of flow of the air around the transfer roller 30 and thereby adjust the temperature of the air. Thus, the change of resistance of the ion-conductive transfer roller 30 can be effectively reduced.

In the illustrated embodiment, the electric voltage of the transfer roller 30 when the measurement current is applied thereto is measured as the index of the resistance value of the transfer roller 30, i.e., as the resistance-related value related to the resistance of the roller 30. Thus, the resistance of the transfer roller 30 can be reliably measured in the simple method.

In the illustrated embodiment, the electric fan 66 as the air-flow-direction changing device is rotatable in each of the two opposite directions. Thus, the direction of flow of the air can be easily changed in the simple method, i.e., by changing the direction of rotation of the fan 66.

In the illustrated embodiment, when the CPU 76 controls the electric fan 66 to be rotated in the air taking direction, the second air flow 93 directed from the fan 66 toward the first passage 72 is generated in the second passage 73 to promote the first air flow 92 directed from the fixing portion 18 toward the transfer roller 30 in the first passage 72. The first air flow 92 flowing from the fixing portion 18 toward the transfer roller 30 has been heated by the heat radiated from the fixing portion 18, and the fan 66 generates the second air flow 93 to positively promote the first air flow 92 toward the transfer roller 30. Thus, a large amount of the heated air is sent toward the transfer roller 30, so that the temperature of the air around the transfer roller 30 is increased and the electric resistance of the same 30 is decreased.

Meanwhile, when the CPU 76 controls the electric fan 66 to be rotated in the air discharging direction, the third air flow 94 directed from the transfer roller 30 toward the fan 66 in the first and second passages 72, 73 is generated against the first air flow 92 directed from the fixing portion 18 toward the transfer roller 30 in the first passage 72. If the first air flow 92 as the heated air flows toward the transfer roller 30, then the temperature of the air around the same 30 cannot be lowered. Hence, it is needed to prevent the first air flow 92 from flowing toward the transfer roller 30. To this end, the fan 66 generates the third air flow 94 to block the first air flow 92 and simultaneously send the high-temperature air around the transfer roller 30 toward the fan 66. That is, the heated air can be prevented from being sent to the transfer roller 30, and the high-temperature air around the same 30 is positively sent to the fan 66. Thus, the temperature of the air around the transfer roller 30 can be lowered and the resistance of the same 30 can be increased.

In short, the electric fan 66 can be selectively rotated in the air taking or discharging direction, so as to change the direction of flow of the air around the transfer roller 30. Therefore, the temperature of the air around the transfer roller 30 can be easily and reliably increased and decreased, and accordingly the transfer roller 30 can stably perform the image transferring operations.

In the illustrated embodiment, the electric fan 66 is provided above the sheet feed path 91. Therefore, the fan 66 can very efficiently generate the first, second, and third air flows 92, 93, 94.

In the illustrated embodiment, when the voltage measured by the voltmeter 78 is higher than the pre-set high-resistance-related threshold value, the electric fan 66 is controlled to be rotated in the air taking direction; and when the measured voltage is lower than the pre-set low-resistance-related threshold value, the fan 66 is controlled to be rotated in the air discharging direction. Therefore, the temperature of the air around the transfer roller 30 can be reliably adjusted in the simple control method in which the high-resistance-related threshold value and the low-resistance-related threshold value are pre-set.

In the illustrated embodiment, when the shutter member 68 is kept at the open position, the air flow between the transfer roller 30 and the fixing portion 18 is allowed. Therefore, the generation of each of the first, second, and third air flows 92, 93, 94 is allowed, and accordingly the temperature of the air around the transfer roller 30 can be easily controlled, i.e., increased or decreased.

Meanwhile, when the shutter member 68 is kept at the closed position, the air flow between the transfer roller 30 and the fixing portion 18 is substantially inhibited. Therefore, the generation of the first air flow 92 is inhibited, and accordingly the temperature of the air around the transfer roller 30 cannot be changed. That is, the heat radiated from the fixing portion 18 can be prevented from being sent toward the transfer roller 30.

In short, when the shutter member 68 is kept at the open position, the temperature of the air around the transfer roller 30 can be easily controlled, i.e., increased or decreased; and when the shutter member 68 is kept at the dosed position, the heat radiated from the fixing portion 18 can be prevented from being sent toward the transfer roller 30, and the control of temperature of the air can be paused.

In the illustrated embodiment, except for the time when the temperature of the air around the transfer roller 30 is not controlled, and the time when the recording sheet 3 is not fed, the heat generated by the fixing portion 18 can be inhibited from being sent toward the transfer roller 30, and the temperature of the air around the same 30 can be prevented from being increased.

Figure 6:
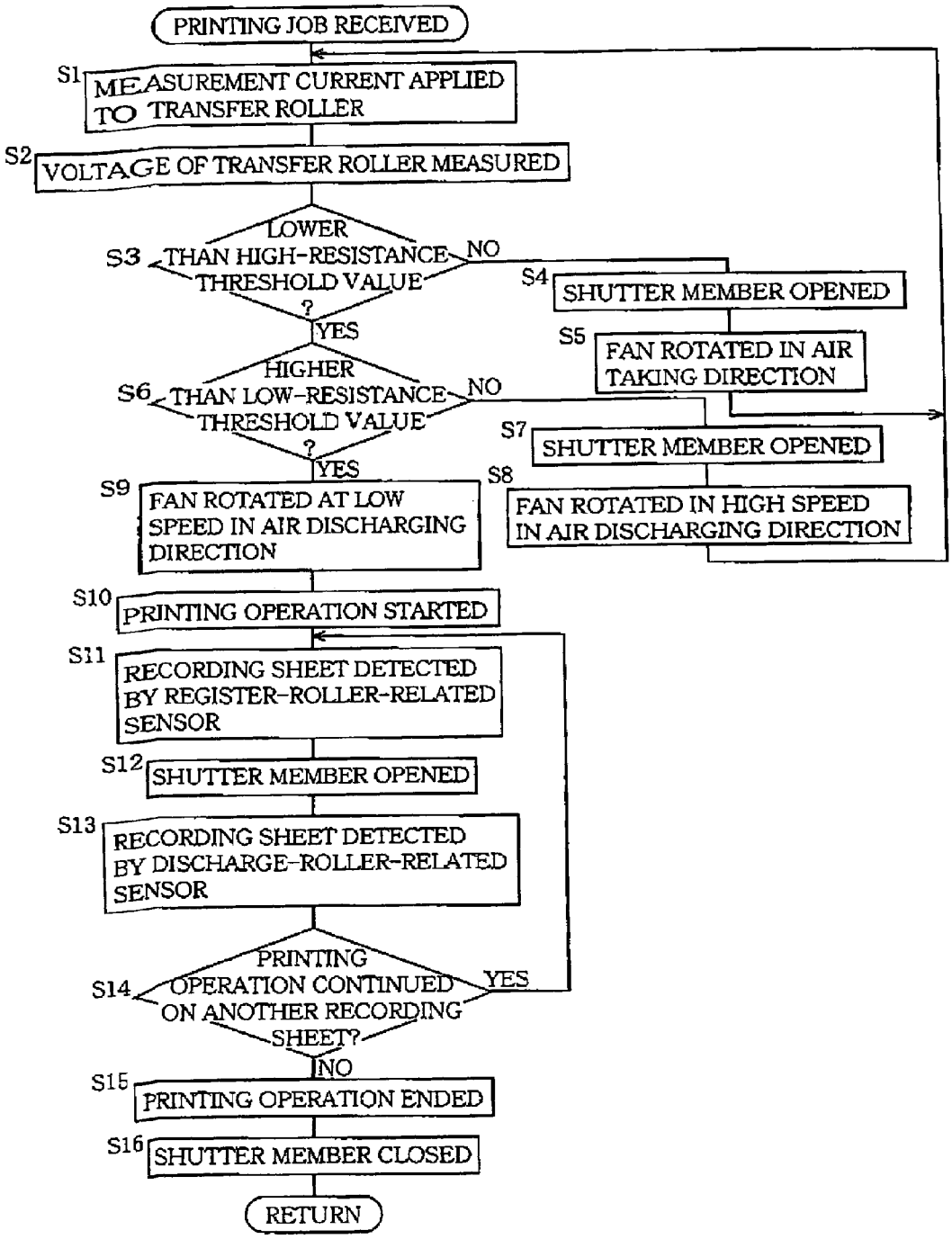
FIG. 6 is a flow chart representing a printing control program incorporating the air-flow-direction changing program.

In the flow chart shown in FIG. 6, when a negative judgment is made at Step 6, the CPU 76 controls, at Step S7, the shutter member 68 to be moved to its open position and controls, at Step S8, the electric fan 66 to be rotated at the high speed in the air discharging direction. However, Steps S7 and S8 may be modified such that the CPU 76 controls the shutter member 68 to be kept at its closed position, and controls the fan 66 to be rotated at a high speed in the air taking direction. In this case, too, an air flow is directed from the fan 66 toward the transfer roller 30 via the side open slot 67*c* of the air duct 67, so that the temperature of the transfer roller 30 is decreased. In addition, the heat roller 41 is quickly cooled by the air flow sent from the fan 66 via the lower open end 67*b* of the air duct 67. In this case, Step S9 may be modified such that CPU 76 controls the fan 66 to be rotated at a low speed in the air taking direction. In the last case, the electric fan 66 is rotated in only one direction, i.e., the air taking direction. Moreover, Step S7 may be modified such that the CPU 76 controls the shutter member 68 to be moved from its closed position where the shutter 68 is aligned with the front wall of the air duct 67, to not its open position but a first air-flow control position where the shutter 68 is aligned with the rear wall of the air duct 67. In this case, the shutter 68 inhibits the heat roller 41 from communicating with the second air-flow passage 73, and thereby inhibits the air flow generated by the fan 66, from conveying the heat generated by the heat roller 41 toward the transfer roller 30. Thus, the transfer roller 30 is cooled down. Alternatively, Step S7 may be modified such that the CPU 76 controls the shutter member 68 to be moved from its closed position to a second air-flow control position where the shutter 68 is aligned with an intermediate position between the front and rear walls of the air duct 67. In this case, the shutter 68 separates the air flow generated by the fan 66 into a first portion directed toward the transfer roller 30 and a second portion directed toward the heat roller 41. Thus, both the transfer roller 30 and the heat roller 41 are cooled down. In these case, too, the fan 66 is rotated, in the air taking direction only at Steps S5, S8 and S9. In these cases, the shutter member 68 may be pivoted by an electric motor that is controllable with respect to its rotation amount or angle.

It is to be understood that the present invention may be embodied with other changes and improvements that may occur to a person skilled in the art, without departing from the spirit and scope of the invention defined in the claims.

What is claimed is:

1. An image forming apparatus, comprising:

a processing apparatus including an image carrier which carries a developing-material image formed by developing an electrostatic latent image with a developing material, a transferring device which transfers the developing-material image from the image carrier to a transfer object, and a cover member which at least partly covers the transferring device and which has at least one air-flow hole which allows an air to flow therethrough between (a) an inner side thereof opposed to the transferring device and (b) an outer side thereof opposite to the inner side;

a resistance-related-value measuring device which measures a resistance-related value of the transferring device;

an air-flow-direction changing device which changes a direction of flow of an air around the transferring device; and a control device which controls the air-flow-direction changing device, based on the resistance-related value measured by the resistance-related-value measuring device.

2. An image forming apparatus, comprising:

an image carrier which carries a developing-material image formed by developing an electrostatic latent image with a developing material;

a transferring device which transfers the developing-material image from the image carrier to a transfer object;

a resistance-related-value measuring device which measures a resistance-related value of the transferring device;

an air-flow-direction changing device which changes a direction of flow of an air around the transferring device; and a control device which controls the air-flow-direction changing device, based on the resistance-related value measured by the resistance-related-value measuring device.

3. The image forming apparatus according to claim 2, further comprising a cover member which at least partly covers the transferring device and which has at least one air-flow hole which allows an air to flow therethrough between (a) an inner side thereof opposed to the transferring device and (b) an outer side thereof opposite to the inner side.

4. The image forming apparatus according to claim 3, wherein the transfer object comprises at least a recording medium, wherein the image forming apparatus further comprises a fixing device which fixes the developing-material image to the recording medium, wherein the fixing device is located on a downstream side of the transferring device in a direction of feeding of the transfer object, wherein the transferring device comprises a rotatable member which engages the image carrier via the transfer object at an image transferring position, and the cover member includes an upstream-side portion and a downstream-side portion located on an upstream side and a downstream side of the image transferring position, respectively, in a direction of rotation of the rotatable member at the image transferring position, and wherein the cover member has said at least one air-flow hole in the upstream-side portion thereof.

5. The image forming apparatus according to claim 3, wherein the transfer object comprises at least a recording medium, wherein the image forming apparatus further comprises a fixing device which fixes the developing-material image to the recording medium, wherein the fixing device is located on a downstream side of the transferring device in a direction of feeding of the transfer object, wherein the transferring device comprises a rotatable member which engages the image carrier via the transfer object at an image transferring position, and the cover member includes an upstream-side portion and a downstream-side portion located on an upstream side and a downstream side of the image transferring position, respectively, in a direction of rotation of the rotatable member at the image transferring position, and wherein the cover member has said at least one air-flow hole around a boundary between the upstream-side and downstream-side portions thereof.

6. The image forming apparatus according to claim 3, wherein said at least one air-flow hole extends over a substantially entire length of the transferring device.

7. The image forming apparatus according to claim 2, wherein the transferring device comprises an ion-conductive transfer roller.

8. The image forming apparatus according to claim 2, wherein the resistance-related-value measuring device measures, as the resistance-related value of the transferring device, an electric voltage of the transferring device when a measurement current is applied thereto.

9. The image forming apparatus according to claim 2, wherein the air-flow-direction changing device comprises an electric fan which is rotatable in each of two opposite directions, and the control device controls the air-flow-direction changing device to change the direction of flow of the air by changing one of the two opposite directions to an other of the two opposite directions.

10. The image forming apparatus according to claim 2, wherein the transfer object comprises at least a recording medium, wherein the image forming apparatus further comprises:

a fixing device which is provided on a downstream side of the transferring device in a direction of feeding of the transfer object and which fixes the developing-material image to the recording medium;

a first passage provided between the transferring device and the fixing device; and a second passage provided between the air-flow-direction changing device and an intermediate connection point of the first passage, wherein the control device controls the air-flow-direction changing device to be rotated in a selected one of (a) a first direction to promote, in the first passage, a first air flow directed from the fixing device toward the transferring device, by generating, in the second passage, a second air flow directed from the air-flow-direction changing device toward the first passage, and (b) a second direction to generate, in the first and second passages, a third air flow directed from the transferring device toward the air-flow-direction changing device, against the first air flow directed from the fixing device toward the transferring device in the first passage.

11. The image forming apparatus according to claim 10, wherein the air-flow-direction changing device is located above the first passage provided between the transferring device and the fixing device, and the second passage provided between the air-flow-direction changing device and the intermediate connection point of the first passage, is inclined relative to the first passage, such that the second passage and a fixing-device-side portion of the first passage that is located on a fixing-device side of the intermediate point of the first passage, cooperates with each other to contain an acute angle.

12. The image forming apparatus according to claim 10, wherein the air-flow-direction changing device is located above a path of feeding of the transfer object from the transferring device to the fixing device.

13. The image forming apparatus according to claim 10, further comprising a memory which stores a high-resistance-related threshold value and a low-resistance-related threshold value, and wherein the control device implements an air-flow-direction changing program including:

a resistance-related-value inputting step of inputting the resistance-related value measured by the resistance-related-value measuring device, a first-direction selecting step of selecting, when the inputted resistance-related value is higher than the high-resistance-related threshold value, the first direction, and controlling the air-flow-direction changing device to be rotated in the selected first direction, and a second-direction selecting step of selecting, when the inputted resistance-related value is lower than the low-resistance-related threshold value, the second direction, and controlling the air-flow-direction changing device to be rotated in the selected second direction.

14. The image forming apparatus according to claim 10, further comprising a shutting device which is provided at the connection point of the first passage where the second passage is connected to the first passage, which allows an air to flow between the fixing device and the air-flow-direction changing device, and allows an air to flow between the transferring device and the air-flow-direction changing device, and which is movable to a selected one of (a) an open position where the shutting device allows an air to flow between the transferring device and the fixing device, and (b) a closed position where the shutting device substantially inhibits an air from flowing between the transferring device and the fixing device.

15. The image forming apparatus according to claim 14, further comprising a feeding detector which detects a feeding of the transfer object from the transferring device toward the fixing device, wherein the air-flow-direction changing program includes a shutting-device control step of controlling the shutting device to be kept at the open position during a controlled time, when one of (a) a first condition that the inputted resistance-related value is higher than the high-resistance-related threshold value, (b) a second condition that the inputted resistance-related value is lower than the low-resistance-related threshold value, and (c) a third condition that the feeding detector has detected the feeding of the transfer object is met, and kept at the closed position when none of the first, second, and third conditions is met.

16. An image forming apparatus, comprising:

an image carrier which carries a developing-material image formed by developing an electrostatic latent image with a developing material;

a transferring device which transfers the developing-material image from the image carrier to a transfer object;

a heat generator which generates a heat;

an air-flow generator which includes an electric fan, and an air passage communicating with the electric fan, the heat generator and the transferring device, and which generates an air flow around the transferring device; and a control device which controls the air-flow generator to increase a temperature of the transferring device, by generating the air flow around the transferring device and conveying the heat generated by the heat generator, to the transferring device via the air passage, and to decrease the temperature of the transferring device, by generating the air flow around the transferring device, without conveying the heat to the transferring device.

17. The image forming apparatus according to claim 16, wherein the electric fan is rotatable in each of two opposite rotation directions, and the control device controls the electric fan to be rotated in a first rotation direction of the two opposite rotation directions so as to generate the air flow in a first air-flow direction in which the heat generated by the heat generator is conveyed to the transferring device via the air passage, and a second rotation direction of the two opposite rotation directions so as to generate the air flow in a second air-flow direction in which the heat generated by the heat generator is not conveyed to the transferring device.

18. The image forming apparatus according to claim 16, wherein the air-flow generator comprises an air-flow control member which is movable to a selected one of (a) an open position where the air-flow control member allows the air flow generated by the air-flow generator to convey the heat generated by the heat generator to the transferring device via the air passage, and (b) an air-flow control position where the air flow control member substantially inhibits the air flow from conveying the heat to the transferring device via the air passage.

19. The image forming apparatus according to claim 18, wherein when the air-flow control member is kept at the air-flow control position, the air flow control member inhibits the heat generator from communicating with the air passage, and allows an air flow generated by the electric fan to be directed toward the transferring device and thereby inhibits the air flow generated by the electric fan from conveying the heat generated by the heat generator, to the transferring device via the air passage.

20. The image forming apparatus according to claim 18, wherein when the air-flow control member is kept at the air-flow control position, the air-flow control member separates an air flow generated by the electric fan, into a first portion directed toward the transferring device and a second portion directed toward the heat generator, and thereby inhibits the first portion of the air flow from conveying the heat generated by the heat generator to the transferring device via the air passage.

21. The image forming apparatus according to claim 16, wherein the transfer object comprises at least a recording medium, wherein the image forming apparatus further comprises a fixing device which is located on a downstream side of the transferring device in a direction of feeding of the transfer object and which includes a heat generating member which thermally fixes the developing-material image to the recording medium, and wherein the heat generator comprises the heat generating member of the fixing device.

* * * * *